US009463639B1

(12) United States Patent
Clippingdale et al.

(10) Patent No.: US 9,463,639 B1
(45) Date of Patent: Oct. 11, 2016

(54) PRINTHEAD CONTROL

(71) Applicant: Tonejet Limited, Royston, Hertfordshire (GB)

(72) Inventors: Andrew John Clippingdale, Royston (GB); Robin Timothy Bacon, Royston (GB)

(73) Assignee: Tonejet Limited, Royston Hertfordshire (GB)

( * ) Notice: Subject to any disclaimer, the term of this patent is extended or adjusted under 35 U.S.C. 154(b) by 0 days.

(21) Appl. No.: 15/036,102

(22) PCT Filed: Nov. 19, 2014

(86) PCT No.: PCT/EP2014/075031
§ 371 (c)(1),
(2) Date: May 12, 2016

(87) PCT Pub. No.: WO2015/075073
PCT Pub. Date: May 28, 2015

(30) Foreign Application Priority Data

Nov. 20, 2013 (EP) ..... 13193724

(51) Int. Cl.
*B41J 2/21* (2006.01)

(52) U.S. Cl.
CPC ..... *B41J 2/2103* (2013.01)

(58) Field of Classification Search
CPC .... B41J 2/2103; B41J 29/38; B41J 2/04588; B41J 2/0458; B41J 2/04581
See application file for complete search history.

(56) References Cited

U.S. PATENT DOCUMENTS 7,857,409 B2 * 12/2010 Hayashi ..... B41J 2/04563 347/14
2007/0146433 A1 6/2007 Kusunoki
2012/0206525 A1 8/2012 Tanase

FOREIGN PATENT DOCUMENTS

EP 0771654 A1 5/1997
WO WO 93/11866 6/1993

(Continued)

OTHER PUBLICATIONS

International Search Report dated Jul. 29, 2015, issued in PCT Application No. PCT/EP2014/075031.

*Primary Examiner* — Thinh Nguyen
(74) *Attorney, Agent, or Firm* — Dickinson Wright PLLC

(57) ABSTRACT

A method of printing a two-dimensional bit-mapped image having a number of pixels per row for printing using a plurality of overlapping printheads or a printhead or printheads indexed through overlapping positions, the or each printhead having a row of ejection channels, each ejection channel having associated ejection electrodes, the method comprising: applying a voltage to the ejection channels sufficient to cause concentration of particles in the printing fluid at the ejection channels, applying voltage pulses of respective predetermined amplitude and/or duration, as determined by respective image pixel bit values, to the electrodes of the selected ejection channels in order to cause volumes of printing fluid to be ejected from selected ejection channels of the overlapping printheads, thereby forming a pixel of a predetermined optical density, adjusting, for each row of the image, the values of the voltage pulses to be applied to the overlapping printheads to form pixels printed by overlapped ejection channels in dependence on the position of the pixel within an overlapped region of the printheads and in dependence on the predetermined optical density of the pixel, wherein, for at least one pixel in the overlapped region, the total volume of ink ejected by the overlapped channels is greater than that required if that pixel were formed by a single ejection channel.

16 Claims, 14 Drawing Sheets

(56) References Cited

FOREIGN PATENT DOCUMENTS

| | | |
|---|---|---|
| WO | WO 97/27056 | 7/1997 |
| WO | WO 97/27058 | 7/1997 |
| WO | WO 98/32609 | 7/1998 |
| WO | WO 01/30576 | 5/2001 |
| WO | WO 03/101741 | 11/2003 |

* cited by examiner

| | | Position across overlap (printhead channel) | | | | |
|---|---|---|---|---|---|---|
| | | 1 | 2 | 3 | … | N |
| Swathe Bitmap Pixel Value | 100% | Print pulse values | | | | |
| | 75% | | | | | |
| | 50% | | | | | |

214

PRINTHEAD CONTROL

BACKGROUND

The present invention relates to electrostatic inkjet print technologies and, more particularly, to printheads and printers of the type such as described in WO 93/11866 and related patent specifications.

Electrostatic printers of this type eject charged solid particles dispersed in a chemically inert, insulating carrier fluid by using an applied electric field to first concentrate and then eject the solid particles. Concentration occurs because the applied electric field causes electrophoresis and the charged particles move in the electric field towards the substrate until they encounter the surface of the ink. Ejection occurs when the applied electric field creates an electrophoretic force that is large enough to overcome the surface tension. The electric field is generated by creating a potential difference between the ejection location and the substrate; this is achieved by applying voltages to electrodes at and/or surrounding the ejection location. One particular advantage of this type of print technology over that of conventional drop-on-demand (DOD) printers is the ability to eject continuously variable ink volume, something which is not possible with conventional DOD printers.

The location from which ejection occurs is determined by the printhead geometry and the position and shape of the electrodes that create the electric field. Typically, a printhead consists of one or more protrusions from the body of the printhead and these protrusions (also known as ejection upstands) have electrodes on their surface. The polarity of the bias applied to the electrodes is the same as the polarity of the charged particle so that the direction of the electrophoretic force is towards the substrate. Further, the overall geometry of the printhead structure and the position of the electrodes are designed such that concentration and ejection occurs at a highly localised region around the tip of the protrusions.

To operate reliably, the ink must flow past the ejection location continuously in order to replenish the particles that have been ejected. To enable this flow the ink must be of a low viscosity, typically a few centipoise. The material that is ejected is more viscous because of the concentration of particles; as a result, the technology can be used to print onto non-absorbing substrates because the material will not spread significantly upon impact.

Various printhead designs have been described in the prior art, such as those in WO 93/11866, WO 97/27058, WO 97/27056, WO 98/32609, WO 01/30576 and WO 03/101741, all of which relate to the so-called Tonejet® method described in WO 93/11866.

FIG. 1 is a drawing of the tip region of an electrostatic printhead 1 of the type described in this prior art, showing several ejection upstands 2 each with a tip 21. Between each two ejection upstands is a wall 3, also called a cheek, which defines the boundary of each ejection cell 5. In each cell, ink flows in the two pathways 4, one on each side of the ejection upstand 2 and in use the ink meniscus is pinned between the top of the cheeks and the top of the ejection upstand. In this geometry the positive direction of the z-axis is defined as pointing from the substrate towards the printhead, the x-axis points along the line of the tips of the ejection upstands and the y-axis is perpendicular to these.

FIG. 2 is a schematic diagram in the x-z plane of a single ejection cell 5 in the same printhead 1, looking along the y-axis taking a slice through the middle of the tips of the upstands 2. This figure shows the cheeks 3, the ejection upstand 2, which defines the position of the ejection location 6, the ink pathways 4, the location of the ejection electrodes 7 and the position of the ink meniscus 8. The solid arrow 9 shows the ejection direction and also points towards the substrate. Each upstand 2 and its associated electrodes and ink pathways effectively forms an ejection channel. Typically, the pitch between the ejection channels is 168 μm (150 channels per inch). In the example shown in FIG. 2 the ink usually flows into the page, away from the reader.

FIG. 3 is a schematic diagram of the same printhead 1 in the y-z plane showing a side-on view of an ejection upstand along the x-axis. This figure shows the ejection upstand 2, the location of the electrode 7 on the upstand and a component known as an intermediate electrode (10). The intermediate electrode 10 is a structure that has electrodes 101, on its inner face (and sometimes over its entire surface), that in use are biased to a different potential from that of the ejection electrodes 7 on the ejection upstands 2. The intermediate electrode 10 may be patterned so that each ejection upstand 2 has an electrode facing it that can be individually addressed, or it can be uniformly metallised such that the whole surface of the intermediate electrode 10 is held at a constant bias. The intermediate electrode 10 acts as an electrostatic shield by screening the ejection channel from external electric fields and allows the electric field at the ejection location 6 to be carefully controlled.

The solid arrow 11 shows the ejection direction and again points in the direction of the substrate. In FIG. 3 the ink usually flows from left to right.

In operation, it is usual to hold the substrate at ground (0 V), and apply a voltage, $V_{IE}$, between the intermediate electrode 10 and the substrate. A further potential difference of $V_B$ is applied between the intermediate electrode 10 and the electrodes 7 on the ejection upstand 2 and the cheeks 3, such that the potential of these electrodes is $V_{IE}+V_B$. The magnitude of $V_B$ is chosen such that an electric field is generated at the ejection location 6 that concentrates the particles, but does not eject the particles. Ejection spontaneously occurs at applied biases of $V_B$ above a certain threshold voltage, $V_S$, corresponding to the electric field strength at which the electrophoretic force on the particles exactly balances the surface tension of the ink. It is therefore always the case that $V_B$ is selected to be less than $V_S$. Upon application of $V_B$, the ink meniscus moves forwards to cover more of the ejection upstand 2. To eject the concentrated particles, a further voltage pulse of amplitude $V_P$ is applied to the ejection upstand 2, such that the potential difference between the ejection upstand 2 and the intermediate electrode 10 is $V_B+V_P$. Ejection will continue for the duration of the voltage pulse. Typical values for these biases are $V_{IE}$=500 volts, $V_B$=1000 V and $V_P$=300 volts.

The voltages actually applied in use may be derived from the bit values of the individual pixels of a bit-mapped image to be printed. The bit-mapped image is created or processed using conventional design graphics software such as Adobe Photoshop and saved to memory from where the data can be output by a number of methods (parallel port, USB port, purpose-made data transfer hardware) to the printhead drive electronics, where the voltage pulses which are applied to the ejection electrodes of the printhead are generated.

One of the advantages of electrostatic printers of this type is that greyscale printing can be achieved by modulating either the duration or the amplitude of the voltage pulse. The voltage pulses may be generated such that the amplitude of individual pulses are derived from the bitmap data, or such that the pulse duration is derived from the bitmap data, or using a combination of both techniques.

Printheads comprising any number of ejectors can be constructed by fabricating numerous cells 5 of the type shown in FIGS. 1 to 3 side-by-side along the x-axis, but in order to prevent gaps in the printed image resulting from spacing between the individual printheads, it may be necessary to 'overlap' the edges of adjacent printheads, by staggering the position of the printheads in the y-axis direction. A controlling computer converts image data (bit-mapped pixel values) stored in its memory into voltage waveforms (commonly digital square pulses) that are supplied to each ejector individually. By moving the printheads relative to the substrate in a controllable manner, large area images can be printed onto the substrate in multiple 'swathes'. It is also known to use multiple passes of one or more printheads to build up images wider than the printhead and to 'scan' or index a single printhead across the substrate in multiple passes.

However, stitch lines frequently result from the use of overlapped printheads or from overlapping on multiple passes and therefore it is known to use interleaving techniques (printing alternate single or groups of pixels from adjacent printheads or from different passes of the same or a different printhead) to distribute and hide the edge effects of the print swathes resulting from the overlapping ends of the printheads. It is generally recognised that a stitching strategy is necessary to obtain good print quality across a join between printed swathes. The known techniques rely on the use of a binary interleaving strategy i.e. a given pixel is printed by one printhead or the other. For example, alternate pixels along the x-axis are printed from adjacent overlapping printheads. Alternatively, a gradual blend from one swathe to the next can be used, by gradually decreasing the numbers of adjacent pixels printed from one printhead while increasing the numbers of adjacent pixels printed from the other printhead. This latter technique can be expanded by dithering the print in the y-axis direction. Another known technique is the use of a saw tooth or sinusoidal 'stitch' to disrupt any visible stitch line.

These techniques all represent different ways in which printing can be alternated between the nozzles of two overlapping printheads and the success of them depends on the droplet placement accuracy and registration of the two printheads, and is particularly sensitive to factors like substrate wander between lines of printheads. This can be mitigated by the dispersion and deliberate movement of the stitch to break up visible lines and disperse the errors over the width of the overlapping regions of the adjacent printed swathes.

An overlapping region between two swathes of print may be concealed by printing each pixel in the overlapping region with a contribution of ink from both printheads or passes, the two contributions adding to give the desired optical density for the specified greylevel of the respective image pixel. However, the optical density that results from the overlaying of two dots may not be equal to the optical density that results from one dot equal to the combined area of the two. Typically, a greater total volume of ink will be required for two overlaid dots to produce the same optical density as one dot. This causes problems for printing technologies that can only eject a limited number of droplet sizes or which form a printed dot from a discrete number of fixed-size droplets that combine on or before reaching the substrate to form a printed dot. Such methods have insufficient resolution of ejected volume to compensate for the change of optical density for pixels that are printed dot-on-dot in the overlapping region and would need to invoke a dithering regime between nearest available drop sizes to achieve the required optical density averaged over an area of many pixels, thereby compromising image resolution in the overlap region.

SUMMARY OF THE INVENTION

The present invention provides a method of printing a two-dimensional bit-mapped image having a number of pixels per row for printing using a plurality of overlapping printheads or a printhead or printheads indexed through overlapping positions, the or each printhead having a row of ejection channels, each ejection channel having associated ejection electrodes, the method comprising: applying a voltage to the ejection channels sufficient to cause concentration of the particles in the printing fluid at the ejection channels, applying voltage pulses of respective predetermined amplitude and/or duration, as determined by respective image pixel bit values, to the electrodes of the selected ejection channels in order to cause volumes of printing fluid to be ejected from selected ejection channels of the overlapping printheads, thereby forming a pixel of a predetermined optical density and/or greylevel, adjusting, for each row of the image, the values of the voltage pulses to be applied to the overlapping printheads to form pixels printed by overlapped ejection channels in dependence on the position of the pixel within an overlapped region of the printheads and in dependence on the predetermined optical density and/or greylevel of the pixel, wherein, for at least one pixel in the overlapped region, the total volume of ink ejected by the overlapped channels is greater than that required if that pixel were formed by a single ejection channel.

This technique provides an alternative strategy to those known in the art, which creates each printed pixel in the overlap region of printheads from a contribution from both printheads in the overlap region, i.e. an ejection from one printhead plus an ejection from the overlapping printhead, which together give a pixel of the required optical density for the specified greylevel of the respective image pixel. The relative contributions from the two printheads change to create a progressive fade-out from the one printhead with an overlapping fade-in to the other printhead across the overlap region. This is less sensitive to dot placement errors and substrate wander, because such errors are less inclined to produce white space between dots.

This fading technique involves reducing the pulse lengths (or else the amplitude) of the ejection voltage pulses to vary the volume of the ink providing the pixels printed in the overlap region so that one printhead fades out as the other fades in, the sum of the print from the two heads producing the required uniformity of pixel optical densities or greylevels across the overlap.

Importantly, one or more of the pixels in the overlapped region have been found to require a total volume of ink from the two ejection channels creating that pixel that is greater than that required if that pixel had been created by a single ejection channel.

The present invention works by utilising the facility of the Tonejet method of continuously variable ejected volume to allow the combined volume of ink ejected from two overlapped printhead ejectors to be fine-tuned to achieve the required optical densities or greylevels in the overlap region. The ejected volume from each ejector in the overlap region is scaled by a numerical multiplier which is dependent on the channel's position in the overlap region and the target optical density or grey level of the pixel. The ejected volume from one printhead may therefore be faded out progressively across the overlap region as the ejected volume from the second printhead is faded in; the sum of the two ejected volumes at any position across the overlap being fine-tuned to achieve the correct optical density for each greylevel of the printed image, which entails controlling the combined ink volume to be generally greater than the volume required for that greylevel for a pixel printed by just one printhead ejector. Whilst it is believed that, for the Tonejet® method due to the viscosity and the quick drying qualities of the ink, all pixels created from two overlapped ejection channels will likely contain a greater volume of ink that if created from a single channel, there could be one or more pixels that do not have a greater volume.

The technique is not usable by other greyscale inkjet technologies whose ejection is limited to a fixed set of droplet sizes as it requires a high level of variable ejection volume control. The Tonejet® method as referred to above, by contrast, has the feature that the ejection volume is continuously, addressably, variable through the mechanism of pulse length control. In the Tonejet® method, for a given pixel greylevel, a continuous-tone pulse value can be assigned to produce the desired dot optical density. Such calibrations are not possible for a conventional drop-on-demand (DOD) printhead whose drop volumes are quantised by chamber volume, nozzle size, etc.

The Tonejet® method allows for continuously variable control of the ejected volume. In practical terms given that the method is implemented digitally, there are a number of discrete levels rather than an infinite number. However, it is preferable that the system operates with at least 64 different levels of ejected volume, more preferably 128 and more preferably still 256. 256 levels means that the ejected volume can be defined by 8-bit data. A typical digital display screen is capable of displaying 256 different levels of each primary colour and, to the naked eye, such resolution appears to be continuously variable.

Similar issues arise and the same solution can be used whether the printheads carry out printing in a single pass, printing the required pixels from multiple (interleaved) printheads closely spaced one behind another, or if the pixels are printed from multiple passes of the same or different printheads. The printhead(s) may be indexed multiple times.

In order to provide the required 'fade', a fading function for each printhead or swathe of print is used to define the profile of the fade across the overlap region. It is usual to restrict the number of greylevels used to specify each pixel in printing with the Tonejet® method to a number of predetermined levels to simplify computations. In the method of the invention it is advantageous to provide a different fading function for each of these predetermined levels. This arises from the fact that the additive print density of pixels printed by two droplets follows a function which is non-linear with droplet volume. The effect of the fading function in the overlap region on a pixel of a said predetermined level is to reduce the volume of ink ejected from each ejector for that pixel by an amount that controlled with the full resolution of the variable ink volume control. Therefore the individual ejected volumes of ink comprising the pixels in the overlap region are not limited to the said predetermined levels that are typically used for the remainder of the printed image. Rather, the two ejected volumes combine to form a pixel whose level corresponds to one of the said predetermined levels.

The invention also includes apparatus for printing a two-dimensional bit-mapped image having a number of pixels per row, said apparatus having a plurality of overlapping printheads or a printhead or printheads indexed through overlapping positions, the or each printhead having a row of ejection channels, each ejection channel having associated ejection electrodes to which a voltage is applied in use sufficient to cause concentration of particles in the printing fluid at the ejection channels, and wherein, in order to cause volumes of printing fluid to be ejected from selected ejection channels of the overlapping printheads thereby forming a pixel of a predetermined optical density and/or greylevel, voltage pulses of respective predetermined amplitude and/or duration, as determined by respective image pixel bit values, are applied to the electrodes of the selected ejection channels, characterised in that for each row of the image, the values of the voltage pulses to be applied to the overlapping printheads to form pixels printed by overlapped ejection channels are adjusted in dependence on the position of the pixel within an overlapped region of the printheads and in dependence on the predetermined optical density and/or greylevel of the pixel, wherein, for at least one pixel in the overlapped region, the total volume of ink ejected by the overlapped channels is greater than that required if that pixel were formed by a single channel ejection.

The present invention may consider the optical density, the greylevel or a combination of both when adjusting the image pixel bit value.

The plurality of overlapping printheads may be fixed in position relative to one another in use.

The plurality of overlapping printheads may comprise a first printhead printing on a first pass over the print substrate and the same or another printhead printing on a later pass over the print substrate and overlapping in position with the position of the first printhead. The first printhead can be indexed between passes over the substrate by a distance equal to the width of the row of channels of the printhead less the desired overlap.

The printhead may be one of a number of identical printheads disposed in a module parallel to one another and offset by a proportion of the distance between adjacent ejection channels whereby the printed image has a resolution greater than the distance between adjacent ejection channels. A plurality of said modules can be overlapped one with another to enable a print width greater than the width of an individual module. Alternatively, the module can be indexed between passes over the substrate by a distance equal to the width of the row of channels of a printhead less the desired overlap.

In the case of a single printhead, the printhead may be indexed by a proportion of the distance between adjacent ejection channels whereby the printed image has a resolution greater than the distance between adjacent ejection channels.

Preferably, the values of the voltage pulses to be applied to individual channels in the overlapping printheads may be determined from one of a set of predetermined fading functions dependent on the level of the predetermined greylevel of the pixel to be printed by the respective channel in the overlapped region of the printheads.

The pixel bit values may be adjusted in dependence on the position of the pixel within an overlapped region of the printheads and in dependence on the predetermined greylevel of the pixel, prior to conversion of the pixel values into voltage pulses of respective predetermined amplitude and/or duration to cause printing.

Alternatively, the pixel bit values of the image may be provided to printhead drive electronics which converts the values into voltage pulses, and the voltage pulse values are therein determined in dependence on the position of the pixel within an overlapped region of the printheads and in dependence on the predetermined greylevel of the pixel, prior to being applied to the ejection electrodes of the printhead.

The values of the voltage pulses to be applied to individual channels in the overlapping printheads may be determined from one of a set of predetermined fading functions dependent on the level of the predetermined optical density of the pixel to be printed by the respective channel in the overlapped region of the printheads.

The pixel bit values may adjusted in dependence on the position of the pixel within an overlapped region of the printheads and in dependence on the predetermined optical density of the pixel, prior to conversion of the pixel values into voltage pulses of respective predetermined amplitude and/or duration to cause printing.

The pixel bit values of the image may be provided to printhead drive electronics which converts the values into voltage pulses, and the voltage pulse values are therein determined in dependence on the position of the pixel within an overlapped region of the printheads and in dependence on the predetermined optical density of the pixel, prior to being applied to the ejection electrodes of the printhead.

The percentage increase in volume of the combined ejected volume relative to a single ejection channel volume may be greatest at the mid point of the overlapped region.

In a particular method, fading functions of the following form can be used to define the profile of the fade across the overlap region of two printheads/swathes of print A and B:

$$f_A(x)=f_{min}+(1-f_{min})(1-x)^{\alpha}$$

$$f_B(x)=f_{min}+(1-f_{min})\cdot x^{\alpha}$$

Where $f_A$ is the fading function of printhead/swathe A $f_B$ is the fading function of printhead/swathe B, which is the mirror-image of $f_A$ $f_{min}$ is the minimum value for the fading function, producing the minimum printable level x is the normalized position across the overlap region, $0 \le x \le 1$ $\alpha$ is the power of the fading function.

In colour printers the printheads of each colour may be provided with different fading functions. The overlap position between printheads of the different colours may also be different.

The fading function may additionally be adjusted, either randomly or according to a suitable waveform function, so as to move the centre point of the fade around within the area of overlap to 'dither', effectively, the stitching between the print swathes to still further reduce the observable artifacts.

The fading functions may be applied at one of a number of stages in the processing of the image for printing, for example:

In the Raster Image Processing software on the controlling computer, resulting in a modified version of each swathe of the bitmap image that may then be converted into print pulses by the printhead drive electronics in the normal way;

In the printhead drive electronics, which in this case may be programmed to generate modified pulse amplitudes or durations in response to incoming pixel value data according to the position of the ejector in the overlap region.

The fading functions may be applied to the pixel value data in the form of a mathematical function in software, or in the form of a look-up table stored in the memory of the controlling computer, the data feed electronics or the pulse generation electronics.

BRIEF DESCRIPTION OF THE DRAWINGS

Examples of methods and apparatus according to the present invention will now be described with reference to the accompanying drawings, in which.

DETAILED DESCRIPTION

The examples illustrated with reference to FIGS. 4 to 11 can utilise printheads and a printing process as generally described with reference to FIGS. 1 to 3 and 12 to 22.

Figure 1:
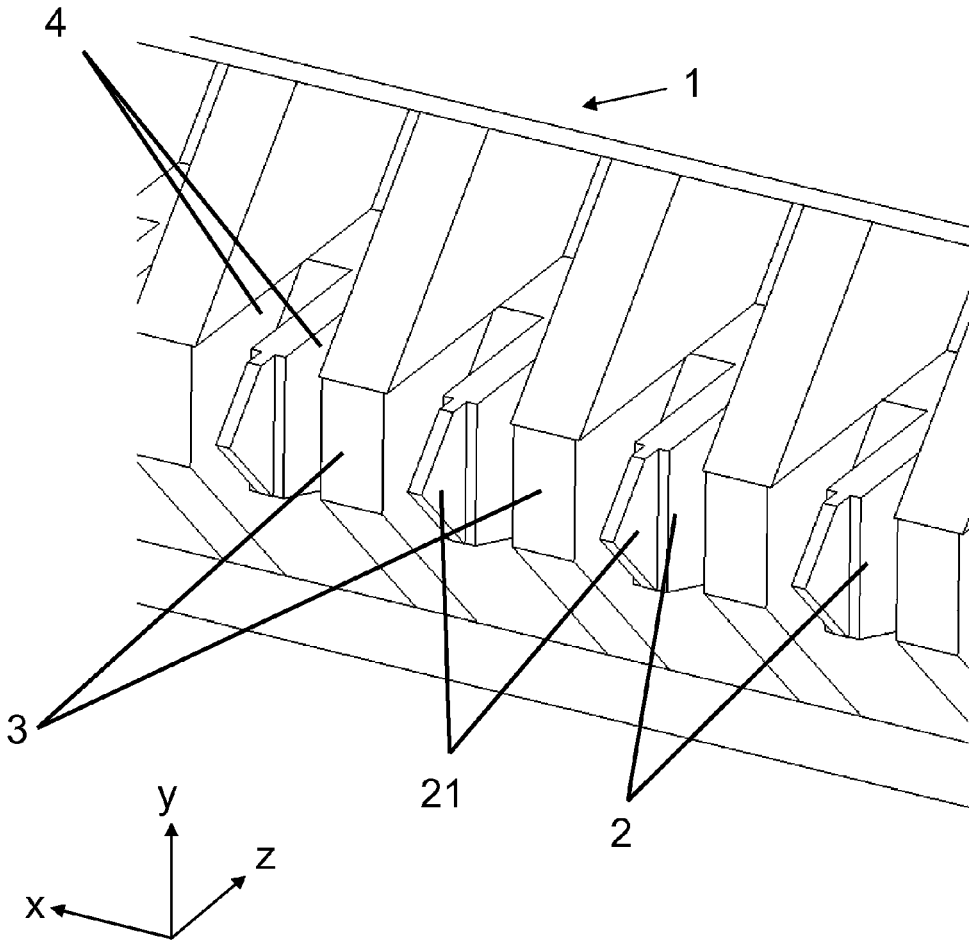
FIG. 1 is a CAD drawing showing detail of the ejection channels and ink feed pathways for an electrostatic printer.
Figure 2:
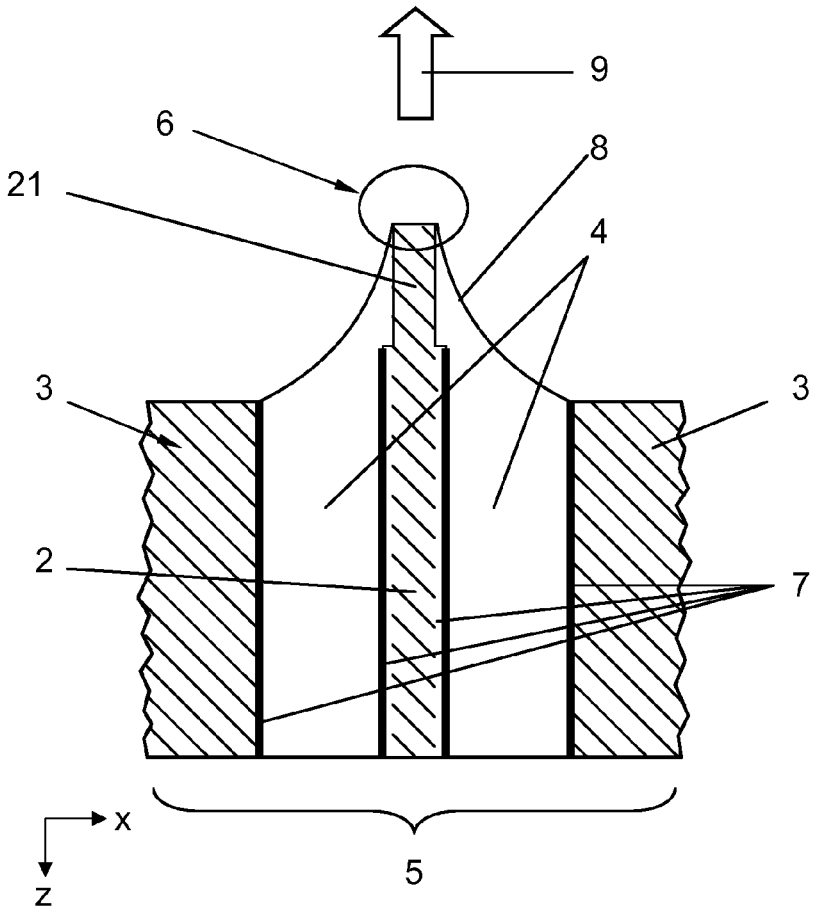
FIG. 2 is a schematic diagram in the x-z plane of the ejection channel in an electrostatic printhead of the type shown in FIG. 1.
Figure 3:
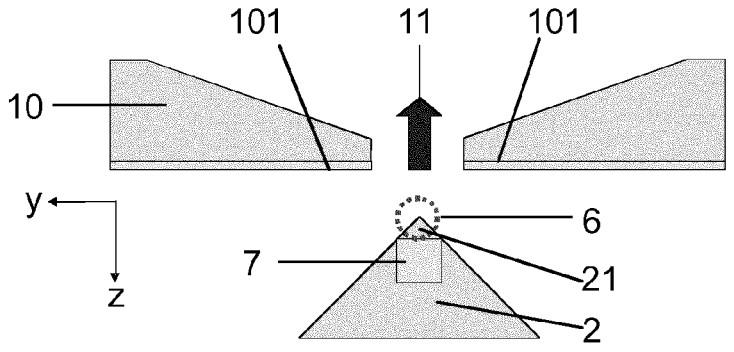
FIG. 3 is a schematic diagram in the y-z plane of the ejection channel in an electrostatic printhead of the type shown in FIG. 1.
Figure 4:
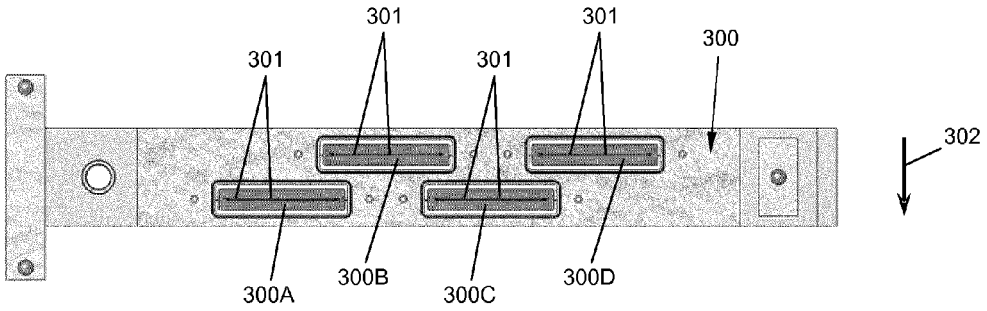
FIG. 4 illustrates a plan view of part of an example of a multi-printhead printer.

FIG. 4 illustrates a printing bar or module 300 utilising four printheads 300A-D, each having multiple print locations (ejection channels or channels) 301 at a spacing providing 150 channels per inch (60 channels per centimeter) (150 dpi printing) to provide an appropriate swathe of the printed image in use, and with an overlap between each printhead and its adjacent printhead(s) such that a number of ejection channels 301 (in this case 10) are overlapped between printhead pairs 300A/300B, 300B/300C & 300C/300D in the direction of print substrate movement (arrow 302) in order to stitch each swathe of print with it neighbour(s).

Figure 5:
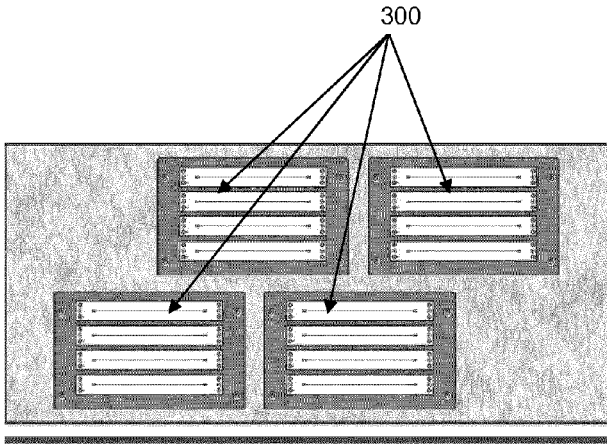
FIG. 5 illustrates a plan view of a number of printhead modules mounted together.

FIG. 5 illustrates a further example of a printer having modules 300 also utilising four printheads 300A-D of the same construction and channel spacing (150 dpi) as those of FIG. 4, but the printheads being disposed substantially in alignment one behind the other in the intended direction of substrate movement and offset across the direction of print substrate motion only by the distance necessary to enable the required higher definition printing, in this case 600 dpi (an offset of approximately 42 μm). In this case, adjacent pixels of the printed image are printed from adjacent printheads to achieve the required print density and the plural modules 300, disposed one behind the other but offset to provide the desired print swathes, produce the desired overall print width in a similar manner to the example of FIG. 4 and hence with a similar overlap of the respective printheads of each module in order to stitch the swathes of print together. The multiple modules 300 together provide a printer of a width sufficient to allow 600 dpi printing in a single pass relative to the substrate.

In a variation (not shown) a single one of the modules as per FIG. 5 is indexed in multiple passes over the substrate across the print motion direction to provide the required number of print swathes to form the overall width of print required. In this case, the overlap of adjacent indexed positions is provided as per the overlap between modules in FIG. 5, to enable stitching of one swathe to another.

Figure 6:
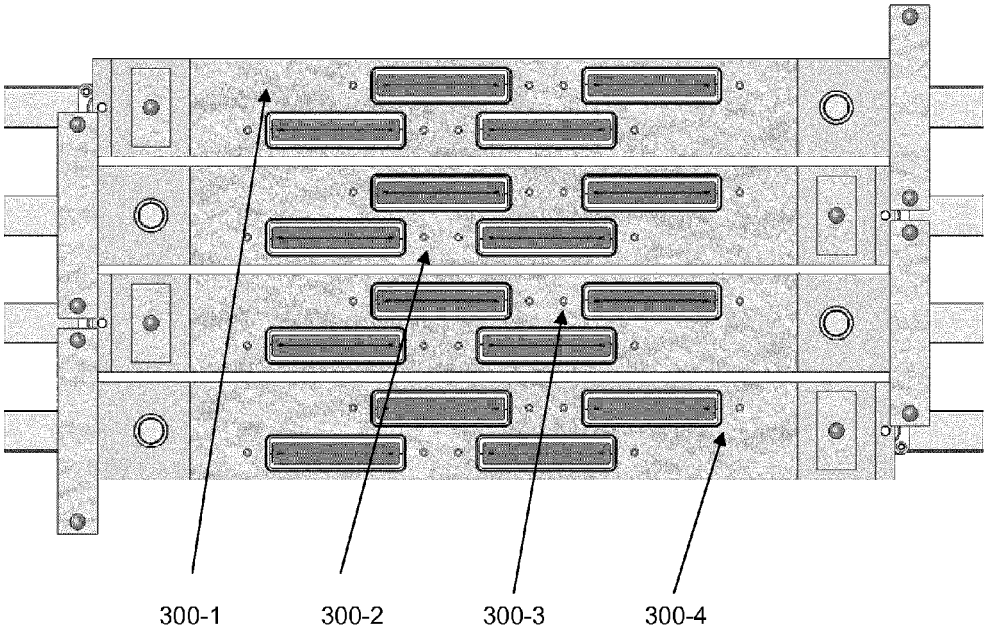
FIG. 6 illustrates an example of another multi-printhead printer arranged in four modules.

FIG. 6 illustrates a still further example having modules 300-1, 300-2, 300-3, 300-4 also arranged to provide for 600 dpi printing from printheads having a 150 dpi spacing, in this case each of the modules being substantially the same as that of FIG. 4, but each successive module being displaced or offset transversely to the print substrate direction of motion by approximately 42 μm. In this case stitching may be effected between adjacent printheads 300A, 300B etc. in each module as per FIG. 4, or between the swathes of print printed by each set of four interleaved printheads that are substantially in alignment with each other in the substrate movement direction 302.

A further example of printhead (not shown) may utilise a single printhead indexed by substantially a quarter of the printhead width between passes to (a) provide (say) 600 dpi printing from a 150 dpi printhead, and (b) an overall print width much greater than the printhead width (the number of indexing motions and hence passes being determined by the desired overall print width. In this case, swathes of 150 dpi print from each pass are interleaved to create 600 dpi print. The overlap between 150 dpi swathes occurs between the first, fifth, ninth, etc. passes/indexations and stitching of the swathes correspondingly occurs between opposite ends of the (single) printhead on the first, fifth, ninth, etc. passes/indexations; similarly, overlap and stitching of 150 dpi swathes occurs between the second, sixth, tenth, etc. passes, between the third, seventh, eleventh, etc. passes and between the fourth, eighth, twelfth, etc. passes.

In all examples, a substrate position synchronisation signal (originating from, for example, a shaft encoder 216 (see FIG. 7) or substrate position servo controller) is used to ensure that droplets are printed at appropriate times depending on the offsets of printheads along the direction of print substrate motion. Such a process is well understood in the art and does not form a part of the present invention. The use of shaft encoders overcomes potential problems otherwise arising from variations in substrate speed relative to the printhead(s) and from offsets of the printhead(s) in the direction of print substrate motion either in printers with multiple offset printheads or in printers with multiple passes of a single printhead or printhead module (having itself multiple printheads).

Before describing an example of the method according to the invention, it may be useful to describe the two methods generally usable to control the volume of fluid printed (or ejected) using the Tonejet® method.

Figure 12:
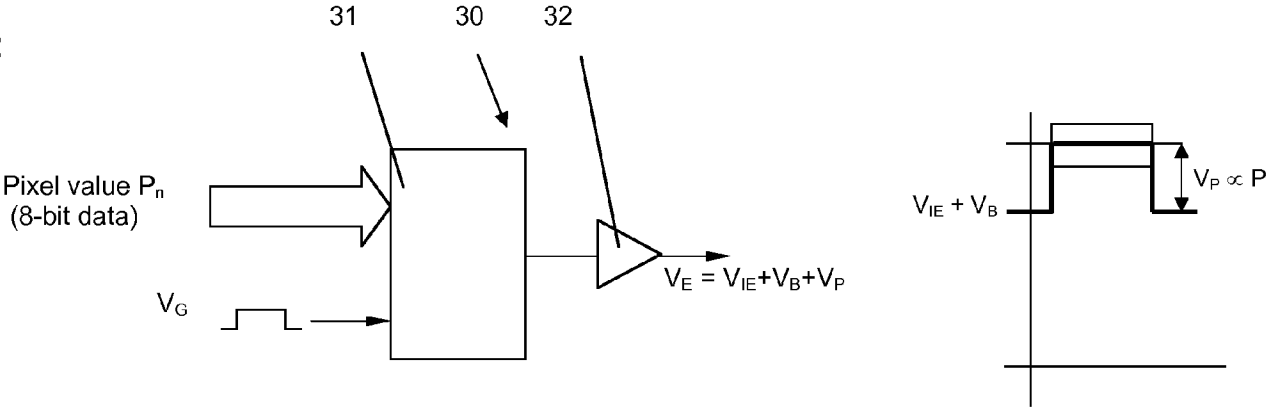
FIG. 12 is a block diagram illustrating how the amplitude of an ejection pulse can be adjusted and a related waveform diagram showing resulting illustrative adjusted amplitudes of a pulse.

FIG. 12 shows the block diagram of a circuit 30 that can be used to control the amplitude of the ejection voltage pulses $V_E$ for each ejector (upstand 2 and tip 21) of the printhead, whereby the value $P_n$ of the bitmap pixel to be printed (an 8-bit number, i.e having values between 0 and 255) is converted to a low-voltage amplitude by a digital-to-analogue converter 31, whose output is gated by a fixed-duration pulse $V_G$ that defines the duration of the high-voltage pulse $V_P$ to be applied to the ejector of the printhead. This low-voltage pulse is then amplified by a high-voltage linear amplifier 32 to yield the high-voltage pulse $V_P$, typically of amplitude 100 to 400V, dependent on the bit-value of the pixel, which in turn is superimposed on the bias voltages $V_B$ and $V_{IE}$ to provide the ejection pulse $V_E=V_{IE}+V_B+V_P$.

Figure 13:
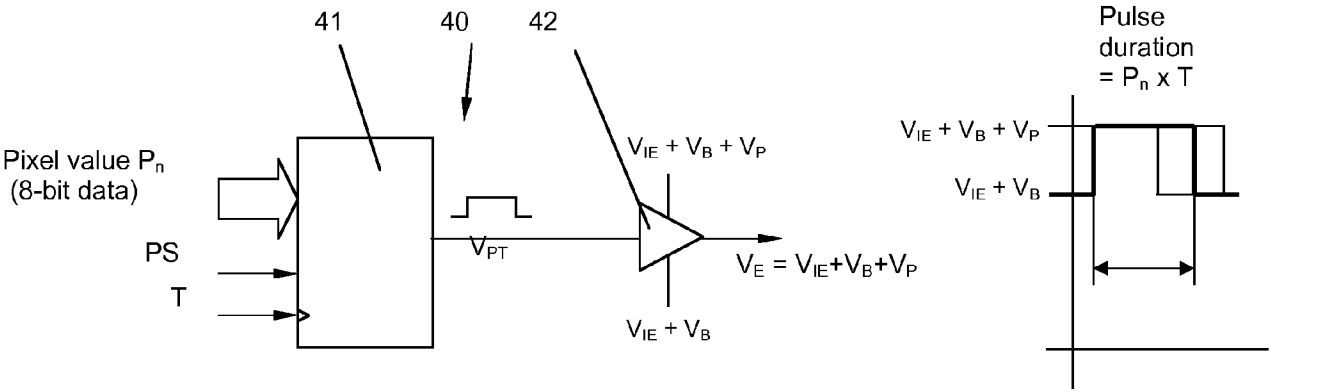
FIG. 13 is a block diagram illustrating how the duration of an ejection pulse can be adjusted and a related waveform diagram showing resulting illustrative adjusted durations of a pulse.

FIG. 13 shows the block diagram of an alternative circuit 40 that can be used to control the duration of the ejection voltage pulses $V_E$ for each ejector of the printhead, whereby the value $P_n$ of the bitmap pixel to be printed is loaded into a counter 41 by a transition of a "print sync" signal PS at the start of the pixel to be printed, setting the counter output high; successive cycles (of period T) of the clock input to the counter cause the count to decrement until the count reaches zero, causing the counter output to be reset low. The counter output is therefore a logic-level pulse $V_{PT}$ whose duration is proportional to the pixel value (the product of the pixel value $P_n$ and the clock period T); this pulse is then amplified by a high voltage switching circuit 42, which switches between a voltage ($V_{IE}+V_B$) when low to ($V_{IE}+V_B+V_P$) when high, thus generating the duration-controlled ejection pulse $V_E=V_{IE}+V_B+V_P$.

The value of $P_n$ of the bitmap pixel to be printed corresponds to a duty cycle (of the ejection pulse) between 0% and 100%. Typically, when printing at a resolution of 600 dpi and with relative motion between the print substrate and the printhead being at a speed of 1 $ms^{-1}$, this equates to a pulse length of between 0 and 42 μm on a 42 μm pulse repetition period.

Of these alternative techniques, in practice it is simpler to modulate the duration of the pulse, but either technique may be appropriate in given circumstances and both may be used together.

Figure 7:
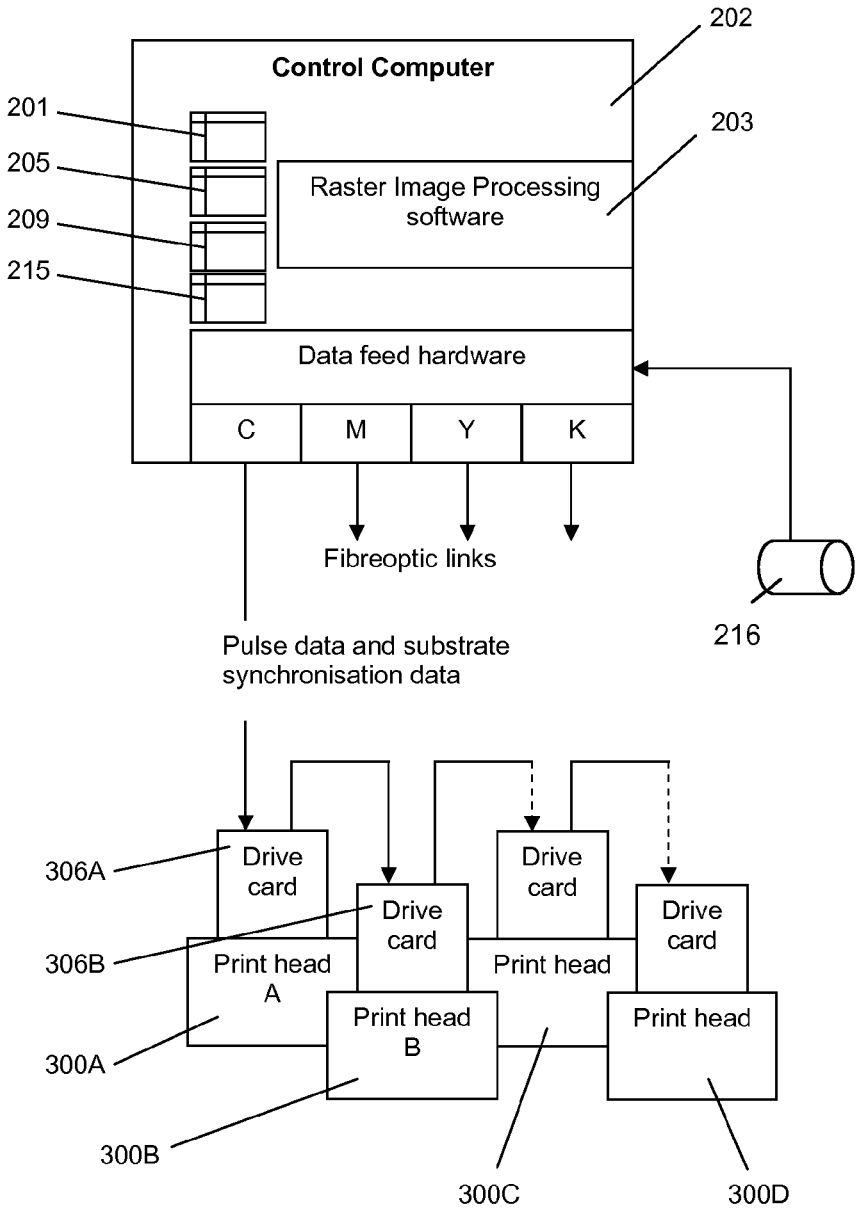
FIG. 7 is a block diagram of some of the printer components of the example of FIGS. 4 and 5.
Figure 8:
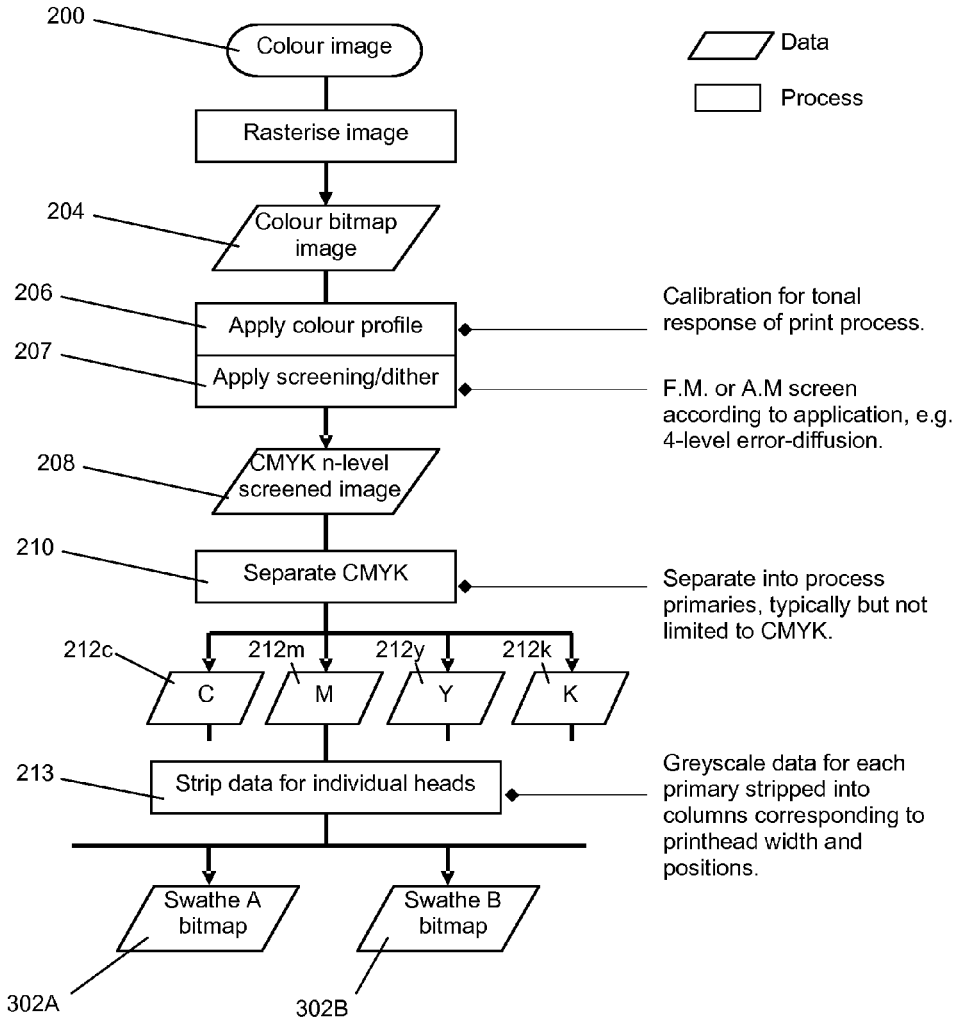
FIG. 8 is a flowchart showing the process of preparing print data for individual printheads of the exemplified printer.

In operation, in one example according to the invention, as shown in FIGS. 4, 7 and 8, a colour image 200, for example created by using (say) any one of a number of well-known image creation software packages such as Adobe Illustrator, is uploaded into a memory 201 of a computer 202. The initial image 200 is then rasterised within the computer 202 using image processing software 203 (see FIGS. 7 and 8) and a corresponding colour bitmap image 204 is then created and saved in memory 205. A colour profile 206 is then applied to the bitmap image to enable a calibration for tonal response of the print process to be achieved, and each pixel is then 'screened' or filtered 207 so that each colour component of the pixel is filtered into one of a number (n) of different 'levels' and the data, representing in this case the CMYK n-level image 208, is then stored in RAM 209 and the individual primary colour components separated 210 into respective data sets 212*c*, 212*m*, 212*y* and 212*k*.

Given the known number of strips or swathes of print which are required to be laid down, greyscale data for each primary colour is then stripped 213 into data sets—in this case two data sets 302A, 302B for one pair of overlapped print swathes or printheads 300A/300B to represent pixel values for each column of the individual printhead widths (number of pixels across the print substrate provided by a single printhead). These data sets provide bitmaps which correspond to the ejection channels 301 of the individual printheads 300A, 300B used to print the final image.

Figure 9:
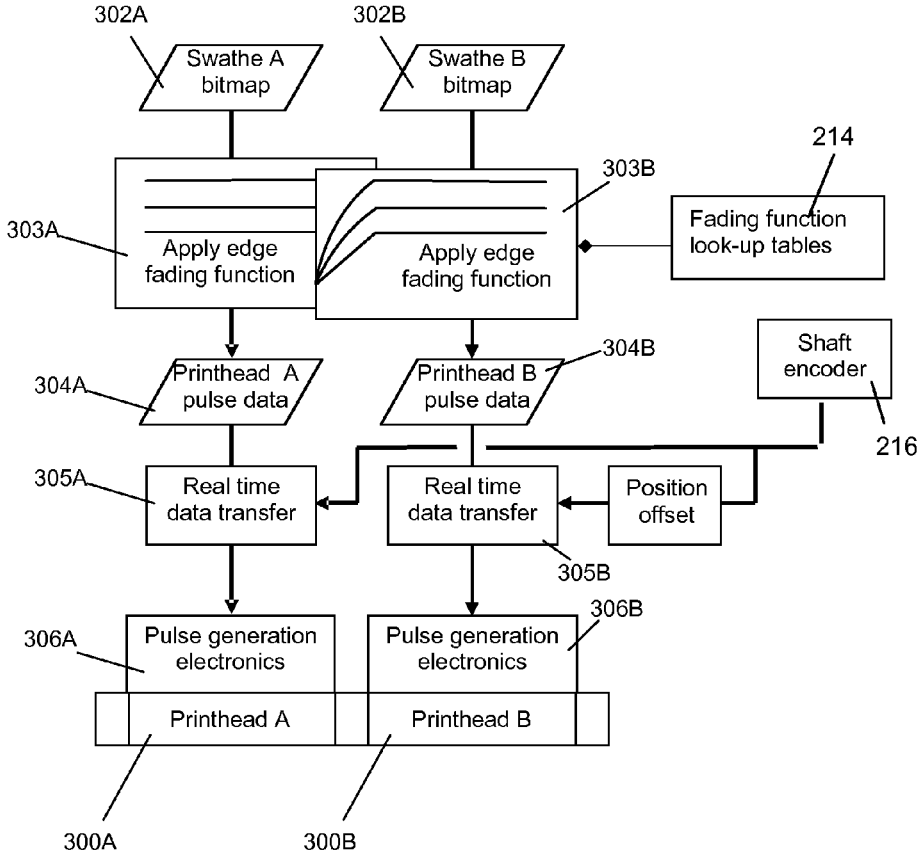
FIG. 9 is a flowchart showing (for simplicity) the process of applying respective fading functions to print data for a pair of printheads of the exemplified printer.

FIG. 9 illustrates the process of 'stitching' the swathes of print of a single colour separation to be generated by adjacent printheads 300A and 300B and specifically illustrates the application of appropriate respective fading functions to the pixel values. The desired fading functions are stored in corresponding look-up tables 214 held within memory 215. Each level of pixel value for each colour will usually have a separate fading function held in the look-up tables 214. The individual fading functions are then applied 303A/303B to each pixel within the bitmap datasets for the individual heads 300A, 300B in accordance with its colour and level to generate pulse length values (or pulse amplitude values or both) to create respective printhead pulse datasets 304A, 304B.

The pulse data 304A, 304B is then transferred in step 305A/305B, according to the relative position of the print substrate and the printheads (as determined by the shaft encoder 216), to the driver cards (pulse generator electronics) 306A, 306B in which the data is utilised to determine the length of the drive pulses applied to the individual printhead ejection channels 301 as required and in which voltage pulses of predetermined duration and/or amplitude are generated according to the pulse data for each pixel. The data is transferred in time-dependency on the substrate position and offset of the ejection channels 301 of one printhead 300A from those of the adjacent overlapping printhead 300B.

A process of generating and applying the fading functions will now be described in an example which uses four passes of two 150 channel per inch printheads overlapped to print a cylindrical substrate with the two overlapped heads spanning the width of the substrate, and the substrate being spun four times to achieve full coverage at 600 dpi. The fading technique described is directly applicable to the overlapped portions of multiple or single printheads making one or more passes over the substrate.

An overlap of 10 printhead channels (40 pixels) is used in the specific example described. However, the width of the overlap region will affect the visibility of the join: generally, the larger the overlap, the more the errors can be dispersed and the less visible the join. This has to be balanced with the desire for the smallest overlap to maximise the print width.

In order to prepare the required fading functions a series of test images were prepared using single printheads and printed with a selection of fading functions to experimentally determine the most effective. The image used was a benchmark test image that contains a full range of print greylevels. The image was screened using a standard 4-level error diffusion method, rendering the image in individual pixel greylevels of 0%, 50%, 75% and 100%. Initial function parameters were estimated and then iterated twice until the print quality looked acceptable. The parameters were then determined to be as follows:

| | Pixel greylevel: | | | | | | | | |
|---|---|---|---|---|---|---|---|---|---|
| | 50% | | | 75% | | | 100% | | |
| Iteration | $f_{min}$ | $P_{min}$ | $\alpha$ | $f_{min}$ | $P_{min}$ | $\alpha$ | $f_{min}$ | $P_{min}$ | $\alpha$ |
| 1 | 0.24 | 0.12 | 0.80 | 0.27 | 0.20 | 0.65 | 0.17 | 0.17 | 0.6 |
| 2 | 0.30 | 0.15 | 0.85 | 0.2 | 0.15 | 0.68 | 0.17 | 0.17 | 0.6 |
| 3 | 0.30 | 0.15 | 0.85 | 0.2 | 0.15 | 0.75 | 0.17 | 0.17 | 0.6 |

Figure 10:
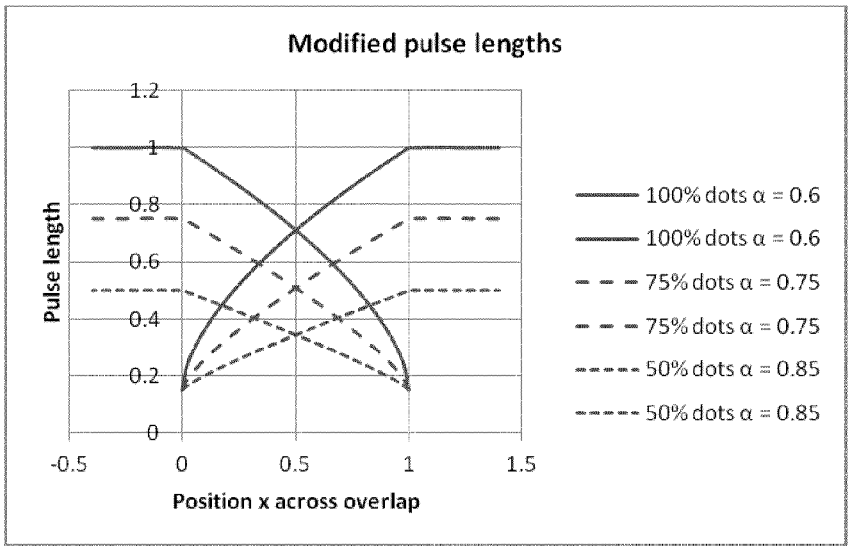
FIG. 10 shows sets of pulse length curves corresponding to the last iteration of the calculated parameters.

For information, the pulse length curves corresponding to the last iteration of the parameters are shown plotted in FIG. 10.

As mentioned above, in this example, for each pixel greylevel, fading functions of the following form are used to define the profile of the fade across the overlap region of two printheads/swathes 300A, 300B of print A and B:

$$f_A(x)=f_{min}+(1-f_{min})(1-x)^{\alpha} \quad \text{Equation 1}$$

$$f_B(x)=f_{min}+(1-f_{min})\cdot x^{\alpha} \quad \text{Equation 2}$$

Where $f_A$ is the fading function of printhead/swathe A $f_B$ is the fading function of printhead/swathe B, which is the mirror-image of $f_A$ $f_{min}$ is the minimum value for the fading function, producing the minimum printable level x is the normalised position across the overlap region, $0 \le x \le 1$ $\alpha$ is the power of the fading function.

Figure 11:
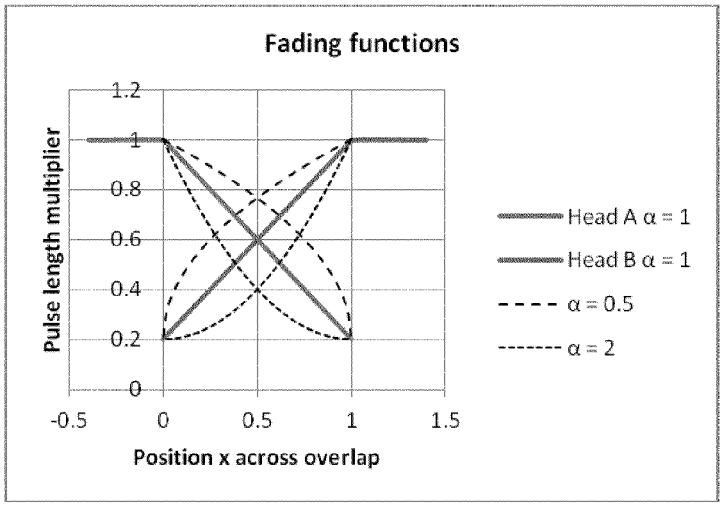
FIG. 11 shows a set of fading functions plotted to show the voltage pulse length multiplier against position across the overlap between a pair of adjacent printheads.

Examples of the fading functions are shown plotted in FIG. 11. The function produces a linear fade for $\alpha=1$, a convex curve for $\alpha<1$ and a concave curve for $\alpha>1$. FIG. 11 shows fading functions for $\alpha=1$, 0.5 and 2. Here $f_{min}$ is set to 0.2.

The fading functions are applied to the image data by multiplying with the image pixel values. This is applied to the image data after screening, i.e. after the pixel values have otherwise been calculated, and may be applied in Raster Image Processing on a controlling computer or in the printhead drive electronics. As the fading function is dependent on the pixel greylevel, the function to apply for a given pixel is chosen according the screened value of that pixel. For example, a 50% level pixel will be multiplied by the fading function for the 50% level, etc. A family of fading functions therefore exists that contains as many curves as there are non-zero pixel greylevels in the screened image (e.g. 3 for a 4-level image; 7 for an 8-level image).

The pixel values that result from multiplying an image pixel of level $P_L$ by the fading function for that level are derived from the following:

Taking the generic fading function for one side (B):

$$f(x)=f_{min}+(1-f_{min})\cdot x^{\alpha} \quad \text{Equation 3}$$

For each pixel level L in the screened image there is a fading function $f_L(x)$:

$$f_L(x)=f_{min_L}+(1-f_{min_L})\cdot x^{\alpha_L} \quad \text{Equation 4}$$

A pixel of level L in position x across the image is faded by multiplying its value $P_L$ by the fading function for its level:

$$P(x)=P_L\cdot f_L(x) \quad \text{Equation 5}$$

$$P(x)=P_L\{f_{min_L}+(1-f_{min_L})\cdot x^{\alpha_L}\} \quad \text{Equation 6}$$

$$P(x)=P_{min_L}+(P_L-P_{min_L})\cdot x^{\alpha_L} \quad \text{Equation 7}$$

where $$P_{min_L}=P_L\cdot f_{min_L}$$

$P_{min_L}$ is a minimum desired pixel value, which is approximately the same whatever the original value $P_L$ of a pixel.

Hence, the pixel values that result from multiplying an image pixel of level $P_L$ by the fading function for that level are:

$$P_A(x)=P_{min_L}+(P_L-P_{min_L})(1-x)^{\alpha_L} \quad \text{Equation 8}$$

$$P_B(x)=P_{min_L}+(P_L-P_{min_L})\cdot x^{\alpha_L} \quad \text{Equation 9}$$

Where $P_A$ is the modified value of the pixel of head/swathe A $P_B$ is the modified value of the pixel of head/swathe B $P_{minL}$ is the minimum desired value for the pixel.

When considering the desired or predetermined optical density of a given pixel, if a volume of ink comprising a pixel is deposited in one event, the liquid ink will spread on the substrate, absorb into it, etc., in a way dependent on the viscosity, surface energy, absorbency etc., forming a characteristic size (area) dot for a given ejected volume. If that volume is deposited instead as two drops separated in time, the first will have started to spread and dry before the second drop impacts. In most cases this will result in a reduced area for the 2-stage printed dot than the single stage dot. The greater area of unprinted substrate around the smaller, two-stage dot has a greater effect on the overall optical density than the higher concentration of pigment in the smaller area dot, so the effect is a reduction in optical density for the 2-stage dot.

The optical density can be modelled as follows.

The optical density that results from patterns of single-colour printed dots may be predicted by the Yule-Nielsen equation:

$$D(\lambda) = -n\log_{10}\left[(1-a)10^{-\frac{D_{sub}(\lambda)}{n}} + a10^{-\frac{D_{ink}(\lambda)}{n}}\right] \quad \text{Equation 10}$$

where:

$D(\lambda)$ is the reflectance density spectrum of the printed area $D_{sub}(\lambda)$ is the reflectance density of the substrate $\lambda$ in the wavelength of light a is the fraction of area covered by ink whose solid reflectance density is $D_{ink}(\lambda)$ n is an empirical correction factor called the Yule-Nielsen factor.

The Yule-Nielsen factor n compensates for the effect of light scattering in the substrate which results in optical dot gain. The effect of dot gain is to increase the observed density of intermediate tones with a peak at 50%. The factor n approaches 1 for a specular surface and approaches 2 for a perfect diffuser; however, for substrates having low internal reflection, values greater than 2 are predicted and are often found in practice.

In the case where a number of inks k are used, the print resembles a mosaic of $2^k$ colours formed from the overlapping combinations of the k inks. For example, in the case of binary CMY printing there are 8 possible colours formed: C, M, Y, CM, MY, YC, CMY and white (substrate) and these are known as the Neugebauer Primaries. The reflectance spectrum of the colour print is given by the Neugebauer equation:

$$R(\lambda)=\Sigma_{i=1}^{8}\alpha_i R_i(\lambda) \text{ with } \Sigma_{i=1}^{8}\alpha_i=1 \quad \text{Equation 11}$$

where:

$a_i$ is the area fraction of the ith primary $R_i(\lambda)$ is the solid reflectance of the ith primary Reflectance is related to Reflectance Density by the relation $D(\lambda)=-\log_{10} R(\lambda)$ Generalising the number of inks to k, each of which may have m density levels, yields $m^k$ Neugebauer primaries corresponding to the $m^k$ superpositions, giving the generalised Neugebauer equation:

$$R(\lambda)=\Sigma_{i=1}^{m^k}\alpha_i R_i(\lambda) \text{ with } \Sigma_i\alpha_i=1 \quad \text{Equation 12}$$

The Yule-Nielson equation may be generalised for $m^k$ Neugebauer primaries yielding the n-modified Neugebauer equation:

$$[R(\lambda)]^{\frac{1}{n}} = \sum_{i=1}^{m^k} a_i[R_i(\lambda)]^{\frac{1}{n}} \quad \text{Equation 13}$$

or in terms of density:

$$D(\lambda) = -n\log_{10}\left[\sum_{i=1}^{m^k} a_i 10^{-\frac{D_i(\lambda)}{n}}\right] \quad \text{Equation 14}$$

Overlapping Dots of the Same Ink

The density of a print containing overlapping dots of the same ink can be modelled using equation 14. For simplicity we shall omit the A dependence from equation 14 since we are considering a single ink colour. Consider the case where the Neugebauer primaries are that of the unprinted substrate, a single layer of ink and a double layer of ink, having densities $D_0$, $D_1$ and $D_2$ and covering area fractions $a_0$, $a_1$ and $a_2$ respectively. If the densities are normalised to the substrate, $D_0$ becomes zero and equation 14 becomes:

$$D = -n\log_{10}\left[a_0 + a_1 10^{-\frac{D_1}{n}} + a_2 10^{-\frac{D_2}{n}}\right] \quad \text{Equation 15}$$

An estimate needs to be made of the density of a double layer of ink $D_2$ whose single layer density is $D_1$. To a first approximation, the density of a mixture equals the sum of the densities of the individual components and scales with layer thickness or concentration, giving $D_2=2D_1$. We use this as a starting point but also show that the overall density D is not particularly sensitive to the value of $D_2$.

We also use an initial approximation that the dot area $a_{dot}$ is proportional to the droplet volume $v_{drop}$; however, this will depend on the ink and substrate properties so we will examine the effect of this at the limits of $a_{dot} \propto v_{drop}$ and $d_{dot} \propto d_{drop}$. (dot diameter proportional to drop diameter.

Figures 14, 15:
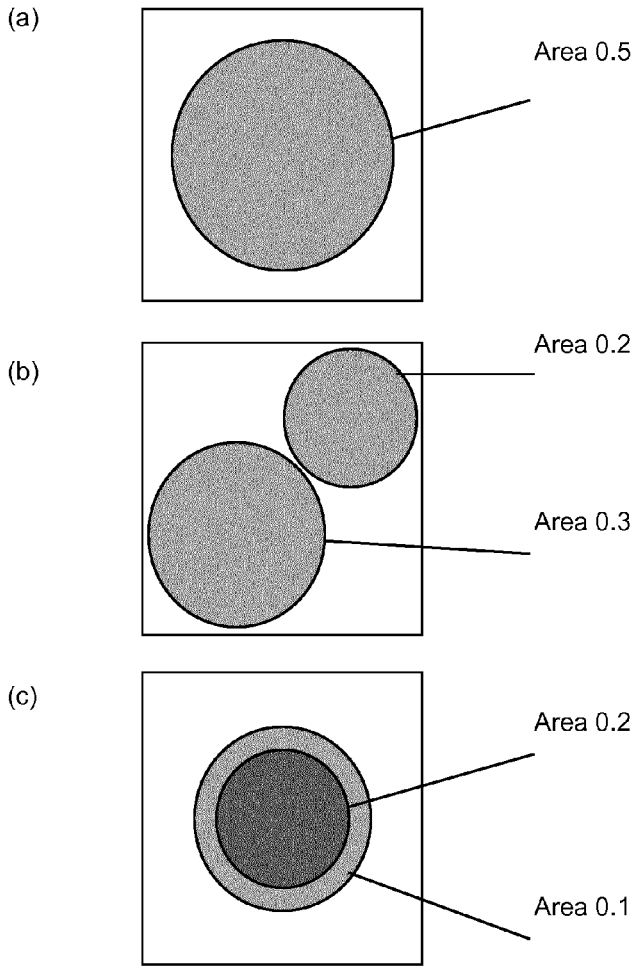
FIG. 14 is a representation of a typical look-up table representing voltage pulse values adjusted in accordance with the corresponding fading function.
FIG. 15 is a diagram showing how three different arrangements of the same area of ink can produce different optical density for a printed pixel.
Figure 16:
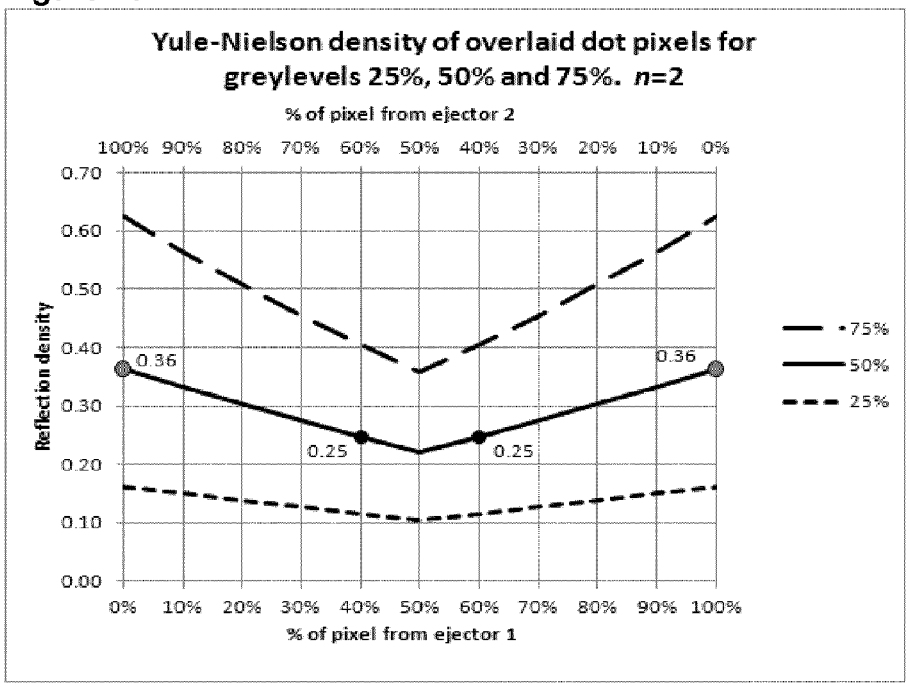
FIG. 16 shows plots of the calculated Yule-Nielson density of a pixel comprising two overlaid dots for greylevels of 25%, 50% and 75%.
Figure 17:
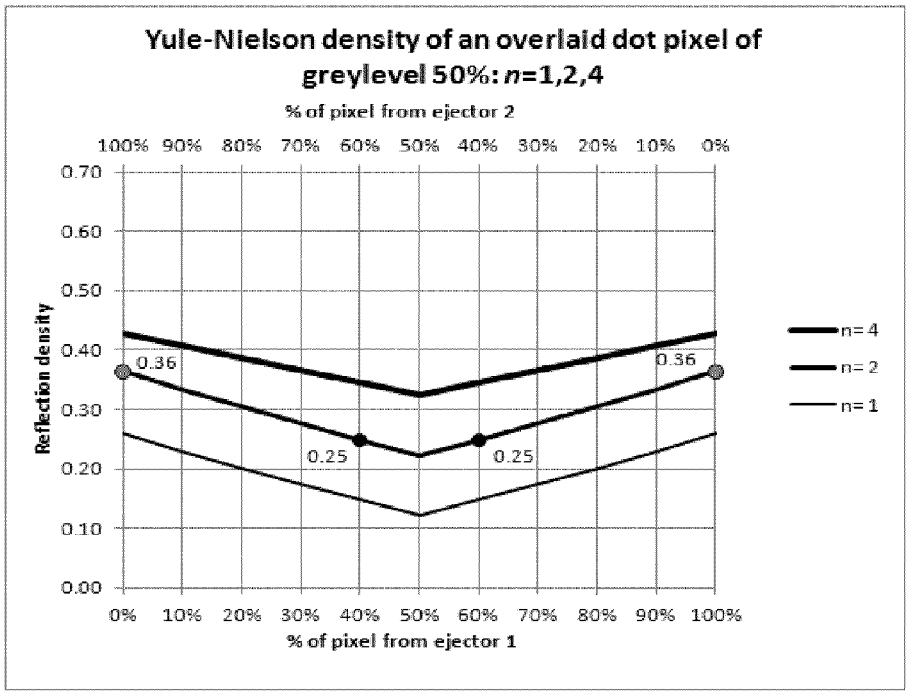
FIG. 17 shows plots of the calculated Yule-Nielson density of a pixel comprising two overlaid dots for dot gain factors of 1, 2 and 4.

FIG. 15 shows three examples of a unit-area pixel printed with the same amount of ink: a single dot; two separate, non-overlapping dots, and the same two dots overlaid. Using dot gain of n=2 (diffusive substrate) in equation 15:

FIG. 15*a*

Single printed dot; ink area 0.5; $D_1=1$ $a_0=0.5$ $a_1=0.5$ $a_2=0$

From Eq. 15: D=0.36

FIG. 15*b*

Separate dots; combined ink area 0.5; $D_1=1$ $a_0=0.5$ $a_1=0.5$ $a_2=0$

From Eq. 15: D=0.36

FIG. 15*c*

Overlaid dots; combined ink area 0.5: $D_1=1$; $D_2=2$ $a_0=0.7$ $a_1=0.1$ $a_2=0.2$ From Eq. 15: D=0.25

Equation 15 predicts a significant reduction in the overall density D for the overlaid dots compared with a single ink layer. This is shown for a wider range of dot sizes in FIG. 16 and with a range of dot gains in FIG. 17. Dot gain arises from the optical effect of light scattering in the substrate, making the coverage appear greater than the actual printed area. The factor n can also be used to account for physical ink spreading on the substrate where the dot becomes larger than the target coverage because of ink spreading.

Figure 18:
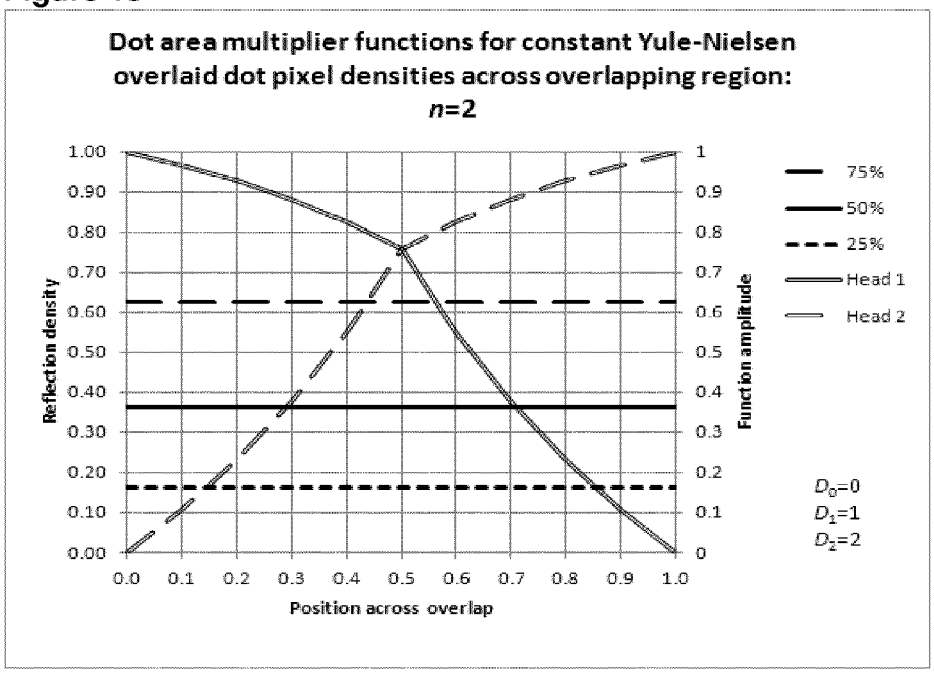
FIG. 18 shows calculated dot area multiplier functions to achieve constant Yule-Nielson density of overlaid dot pixels in an overlapping region of two stitched heads.
Figure 19:
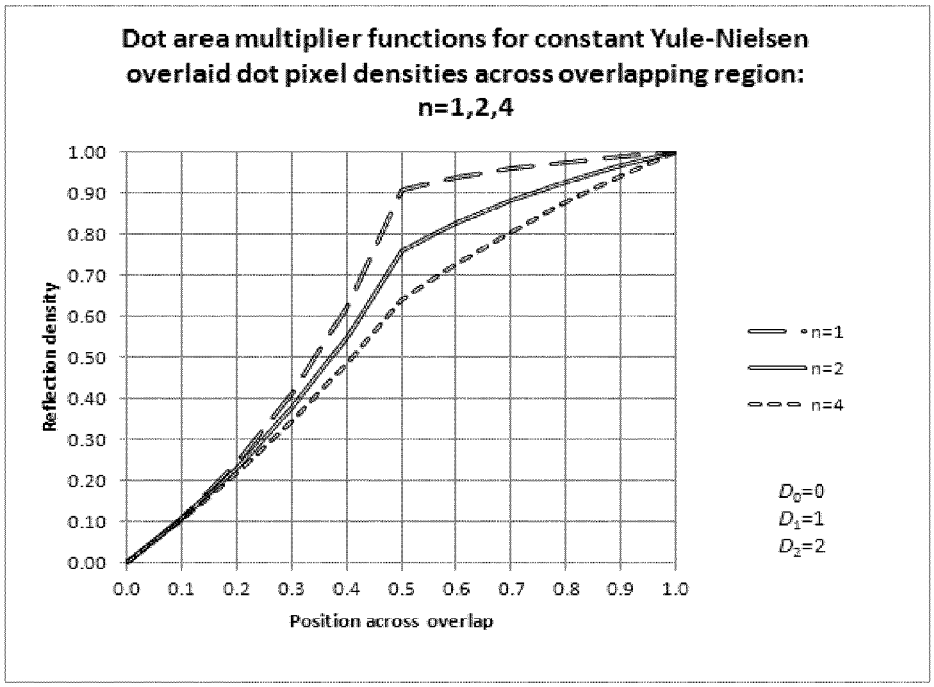
FIG. 19 shows the equivalent dot area multiplier functions for dot gain factors of 1, 2 or 4

To compensate the shortfall in optical density of a pixel that results from printing overlaid dots, the sum of the two ejected volumes at any position across the overlap can be fine-tuned to achieve the correct optical density for each greylevel of the printed image by controlling the combined ink volume to be greater than the volume required for that greylevel for a pixel printed by just one printhead. FIG. 18 plots a dot area multiplier, as a function of position across the overlap, that creates uniform pixel density from the pair of overlaid dots plus the surrounding unprinted area, which comprises each pixel. In this example, the dot gain factor n is 2. The same function is applied to both heads, the function for head 2 being mirrored at the mid-way position with respect to head 1. The plots of the three example greylevels: 25%, 50% and 75%, show that, when the dot area values of pixels to be printed in the overlap region are multiplied by the value of their respective area multiplier function value for the respective heads at that position in the overlap, the model predicts uniform optical density across the overlap. The equivalent area multiplier functions for a range of n from 1 to 4 are shown in FIG. 19.

Sensitivity to $D_1$ and $D_2$

Figure 20:
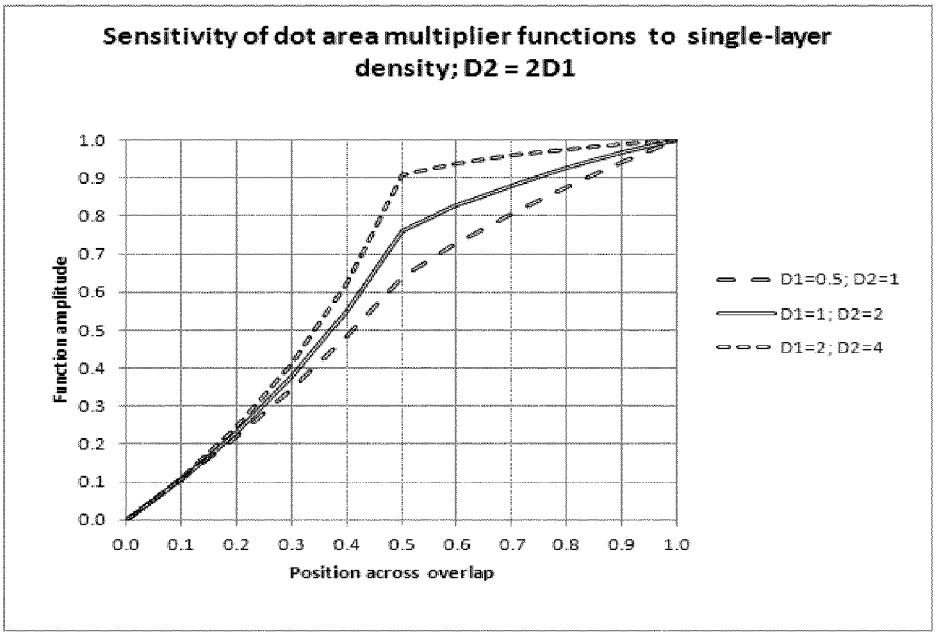
FIG. 20 shows the equivalent dot area multiplier functions for different single-layer ink densities.

FIG. 20 plots the area multiplier versus position for uniform optical density in the case of single layer solid ink densities $D_1$ of 0.5, 1 (as FIG. 18) and 2, while keeping $D_2=2D_1$. It shows that the form of the function remains the same over this range of single-layer density. The denser ink leads to a more pronounced transition at the mid-way position where the dot areas from the two ejectors are equal.

Figure 21:
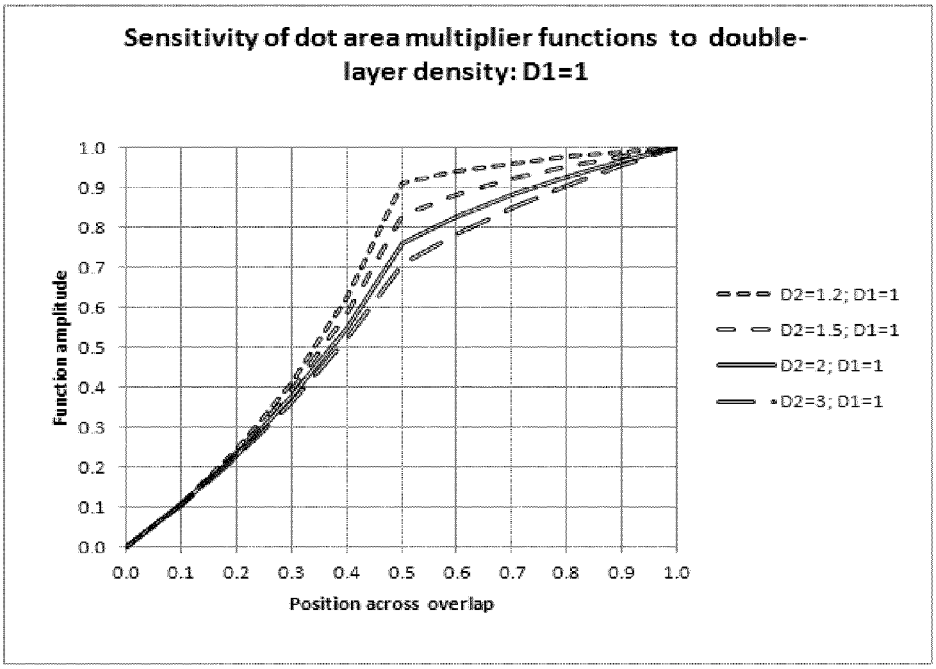
FIG. 21 shows the equivalent dot area multiplier functions for different double-layer ink densities.

FIG. 21 plots the area multiplier versus position for uniform optical density in the case where the double-layer density $D_2$ is modelled as 1.2 times, 1.5 times, 2 times (as in the preceding figures) and 3 times the single layer density $D_1$. This shows that the area multiplier function is fairly insensitive to the exact optical density that results from the overlaying of two single layers.

Drop Volume

The dot area that results from a certain drop volume is dependent on the spreading characteristics of the ink on the given substrate and will depend on at least:

ink viscosity surface energies of ink and substrate absorbency drop velocity

The two limits we will consider are:

1. The dot area is proportional to the drop volume: $a_{dot} \propto v_{drop}$; e.g. if the ink were to spread to form a uniform layer on a non-absorbing substrate;
2. The dot diameter is proportional to the drop diameter: $d_{dot} \propto d_{drop}$; e.g. if the ink absorbed into the substrate with negligible spread to form a dot of similar diameter to the droplet.

Figure 22:
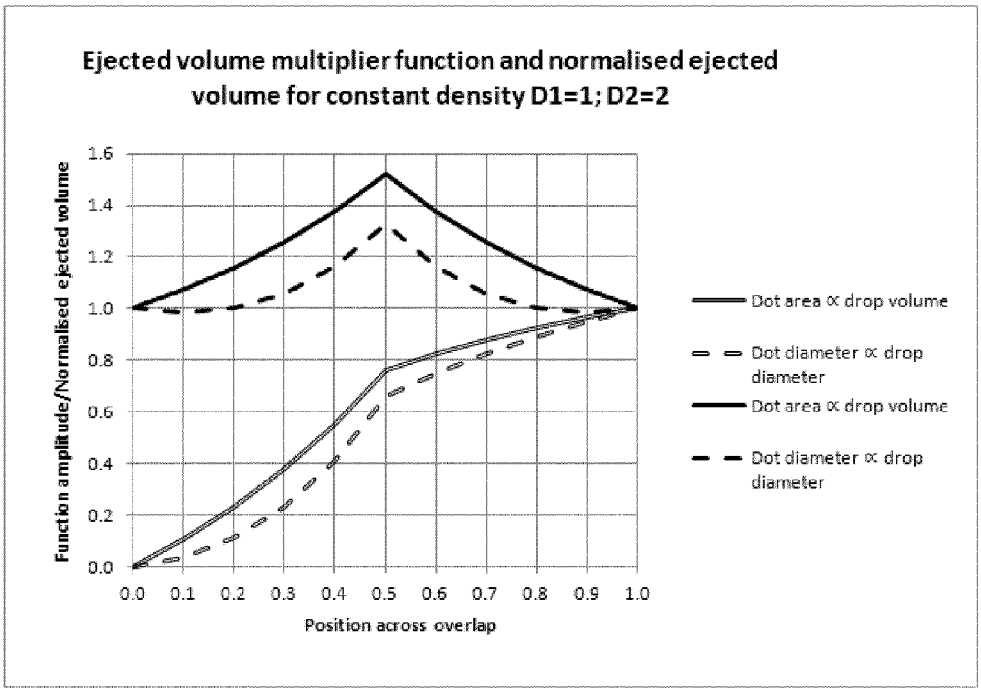
FIG. 22 shows the calculated ejected volume multiplier function and normalized ejected volume across an overlapping region of two stitched heads for two different drop spreading regimes.

FIG. 22 shows the effect on the shape of a volume multiplier function for these two cases. The functions are derived from the area multiplier function for n=2, $D_1=1$ and $D_2=2$. The shape is equal to the area multiplier function in the case of $a_{dot} \propto v_{drop}$, and follows the 3/2 power of it for $d_{dot} \propto d_{drop}$.

Also shown in FIG. 22 is the total ejected volume, normalised to 1 at the boundaries of the overlap region, that results from applying the volume multiplier function to the heads, the function for head 2 being mirrored with respect to head 1. At both limits of drop spreading, the volume at the mid-point is seen to be higher than at the boundaries.

Thus, a non-linear function of ejected volume versus position in the overlapping region is predicted, with a larger volume of ink required to print a pixel from two overlaid dots than for a single dot to meet the same value of optical density for the pixel. This results in a volume multiplier (fading) function that is substantially convex, i.e. it's value at the mid-position of the overlap region is greater than 0.5.

Continuous control of ejected volume in the overlap region is necessary to implement stitching by this method without invoking screening methods that reduce the spatial resolution of the print.

The invention claimed is:

1. A method of printing a two-dimensional bit-mapped image having a number of pixels per row for printing using a plurality of overlapping printheads (300) or a printhead or printheads indexed through overlapping positions, the or each printhead having a row of ejection channels (301), each ejection channel having associated ejection electrodes (7), the method comprising:

applying a voltage to the ejection channels sufficient to cause concentration of particles in the printing fluid at the ejection channels, applying voltage pulses of respective predetermined amplitude and/or duration, as determined by respective image pixel bit values, to the electrodes of the selected ejection channels in order to cause volumes of printing fluid to be ejected from selected ejection channels of the overlapping printheads, thereby forming a pixel of a predetermined optical density and/or greylevel, adjusting, for each row of the image, the values of the voltage pulses to be applied to the overlapping printheads to form pixels printed by overlapped ejection channels (301) in dependence on the position of the pixel within an overlapped region of the printheads (300) and in dependence on the predetermined optical density and/or greylevel of the pixel, wherein, for at least one pixel in the overlapped region, the total volume of ink ejected by the overlapped channels is greater than that required if that pixel were formed by a single ejection channel.

2. A method according to claim 1, wherein the plurality of overlapping printheads (300) are fixed in position relative to one another in use.

3. A method according to claim 1, wherein the plurality of overlapping printheads (300) comprise a first printhead printing on a first pass over the print substrate and the same or another printhead printing on a later pass over the print substrate and overlapping in position with the position of the first printhead.

4. A method according to claim 3, wherein the first printhead (300) is indexed between passes over the substrate by a distance equal to the width of the row of channels (301) of the printhead less the desired overlap.

5. A method according to claim 3, wherein the printhead (300) is indexed by a proportion of the distance between adjacent ejection channels (301) whereby the printed image has a resolution greater than the distance between adjacent ejection channels.

6. A method according to claim 1, wherein each printhead (300) is one of a number of identical printheads disposed in a module parallel to one another and offset by a proportion of the distance between adjacent ejection channels (301) whereby the printed image has a resolution greater than the distance between adjacent ejection channels.

7. A method according to claim 6, comprising a plurality of said modules (300-1-300-4) overlapped one with another to enable a print width greater than the width of an individual module.

8. A method according to claim 6, wherein the module (300) is indexed between passes over the substrate by a distance equal to the width of the row of channels (301) of a printhead less the desired overlap.

9. A method according to claim 1, wherein the values of the voltage pulses to be applied to individual channels in the overlapping printheads (300) are determined from one of a set of predetermined fading functions dependent on the greylevel of the pixel to be printed by the respective channel in the overlapped region of the printheads.

10. A method according to claim 1, in which the pixel bit values are adjusted in dependence on the position of the pixel within an overlapped region of the printheads (300) and in dependence on the predetermined greylevel of the pixel, prior to conversion of the pixel values into voltage pulses of respective predetermined amplitude and/or duration to cause printing.

11. A method according to claim 1, in which the pixel bit values of the image are provided to printhead drive electronics (306A, 306B) which converts the values into voltage pulses, and the voltage pulse values are therein determined in dependence on the position of the pixel within an overlapped region of the printheads (300) and in dependence on the predetermined greylevel of the pixel, prior to being applied to the ejection electrodes of the printhead.

12. A method according to claim 1, wherein the values of the voltage pulses to be applied to individual channels in the overlapping printheads (300) are determined from one of a set of predetermined fading functions dependent on the level of the predetermined optical density of the pixel to be printed by the respective channel in the overlapped region of the printheads.

13. A method according to claim 1, in which the pixel bit values are adjusted in dependence on the position of the pixel within an overlapped region of the printheads (300) and in dependence on the predetermined optical density of the pixel, prior to conversion of the pixel values into voltage pulses of respective predetermined amplitude and/or duration to cause printing.

14. A method according to claim 1, in which the pixel bit values of the image are provided to printhead drive electronics (306A, 306B) which converts the values into voltage pulses, and the voltage pulse values are therein determined in dependence on the position of the pixel within an overlapped region of the printheads (300) and in dependence on the predetermined optical density of the pixel, prior to being applied to the ejection electrodes of the printhead.

15. A method according to claim 1, wherein the percentage increase in volume of the combined volume relative to a single ejection channel volume is greatest at the mid point of the overlapped region.

16. Apparatus for printing a two-dimensional bit-mapped image having a number of pixels per row, said apparatus having a plurality of overlapping printheads (300) or a printhead or printheads indexed through overlapping positions, the or each printhead having a row of ejection channels (301), each ejection channel having associated ejection electrodes to which a voltage is applied in use sufficient to cause concentration of particles in the printing fluid at the ejection channels, and wherein, in order to cause volumes of printing fluid to be ejected from selected ejection channels of the overlapping printheads thereby forming a pixel of a predetermined optical density and/or greylevel, voltage pulses of respective predetermined amplitude and/or duration, as determined by respective image pixel bit values, are applied to the electrodes of the selected ejection channels, characterised in that for each row of the image, the values of the voltage pulses to be applied to the overlapping printheads (300) to form pixels printed by overlapped ejection channels (301) are adjusted in dependence on the position of the pixel within an overlapped region of the printheads and in dependence on the predetermined optical density and/or greylevel of the pixel, wherein, for at least one pixel in the overlapped region, the total volume of ink ejected by the overlapped channels is greater than that required if that pixel were formed by a single channel ejection.

* * * * *